US005934135A

United States Patent [19]

Webster

[11] Patent Number: 5,934,135

[45] Date of Patent: Aug. 10, 1999

[54] APPARATUS AND METHOD FOR NEAR NET WARM FORGING OF COMPLEX PARTS FROM AXI-SYMMETRICAL WORKPIECES

[75] Inventor: James Webster, Pleasant Ridge, Mich.

[73] Assignee: MSP Industries Corporation, Oxford, Mich.

[21] Appl. No.: 09/065,611

[22] Filed: Apr. 24, 1998

[51] Int. Cl.[6] ..... B21J 13/02

[52] U.S. Cl. ..... 72/359; 72/352

[58] Field of Search ..... 72/352, 359, 377

[56] References Cited

U.S. PATENT DOCUMENTS 4,319,477 3/1982 Tasseron ..... 72/352

4,426,872 1/1984 Gatny .

4,702,152 10/1987 Yoneda ..... 72/359

*Primary Examiner*—Lowell A. Larson

*Attorney, Agent, or Firm*—Oliff & Berridge, PLC

[57] ABSTRACT

A female die of a closed die set and a punch for near net warm forging complex shaped parts such as lugs from axi-symmetrical workpieces are disclosed. The punch includes a bottom forming surface having opposed chamfer surfaces which move workpiece material laterally in the cavity, prior to and during warm forging, such that the die cavity is substantially evenly filled. Consequently, the resulting parts are evenly filled without requiring that the workpieces fit snugly in the die cavity.

39 Claims, 4 Drawing Sheets

FIG. 3A
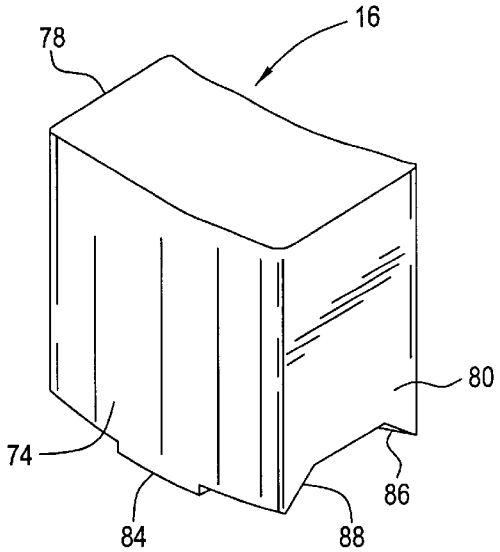
FIG. 3B
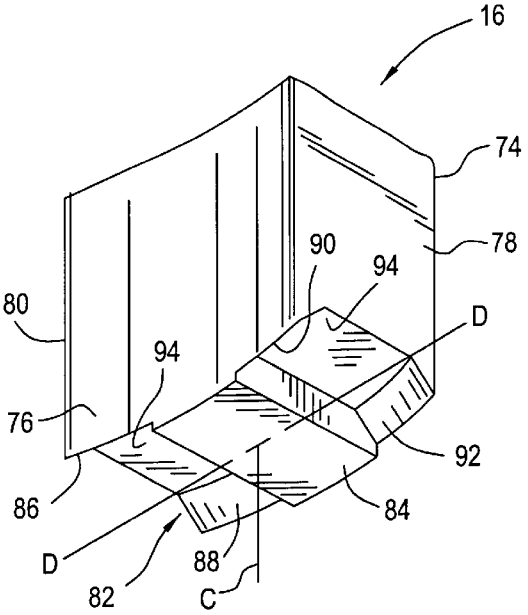
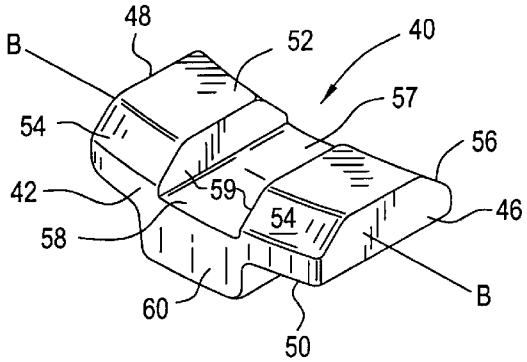
FIG. 2A
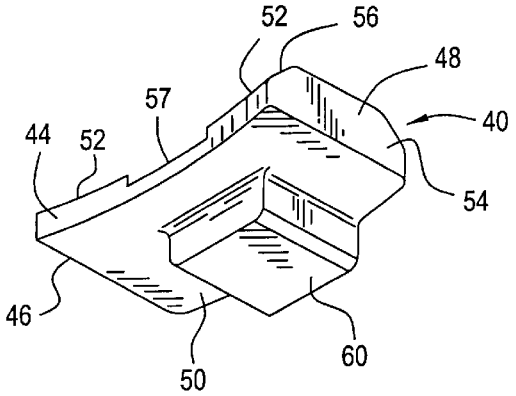
FIG. 2B

APPARATUS AND METHOD FOR NEAR NET WARM FORGING OF COMPLEX PARTS FROM AXI-SYMMETRICAL WORKPIECES

BACKGROUND OF THE INVENTION

1. Field of Invention

The present invention is directed to metal forging and, more particularly, to apparatuses for use in a forging press to near net warm forge relatively complex shaped parts from axi-symmetrical workpieces (billets), and also to a forging methods utilizing the apparatuses to produce such part configurations from such workpieces.

2 Description of Related Art

Known near net warm forging apparatuses and processes can produce parts with high dimensional accuracy. In near net forging, the workpieces (billets) must have approximately the same volume (and weight) as the finished parts. Known near net warm forging apparatuses and processes can generally reduce processing costs by efficient material utilization, simplifying secondary operations, and reducing the number of processing steps.

However, the forged parts will be underfilled if the workpiece volume is too low (underpacked), and the forged parts will have a significant amount of excess material that must be removed by secondary operations if the workpiece volume is too high (overpacked). Also, because near net warm forging dies and punches are usually designed with tight tolerances, use of too large workpieces will cause undue wear of the dies and punches.

Moreover, known near net forging apparatuses and processes are not capable of producing satisfactory parts having certain complex configurations. Exemplary part configurations that can not be produced in a satisfactory manner by near net warm forging are configurations that are curved in one plane and stepped in other planes transverse to the planes in which they are curved. These parts have not been evenly formed by present near net warm forging apparatuses and methods. These configurations are intended as a sample of the part configurations which can not be satisfactorily formed by known near net warm forging apparatuses and methods; there are many other such configurations.

One reason why known near net warm forging apparatuses and processes are unable to satisfactorily manufacture such part configurations is because the apparatuses and processes do not evenly fill the cavities in the dies for forming such parts. If the cavities are not substantially evenly filled, rollover and other forging phenomenon may occur which may result in defective parts.

Another reason why known near net warm forging apparatuses and processes are unable to produce satisfactory parts of certain part configurations pertains to the relationship (i.e., fit) between the workpieces and the die cavities. Specifically, the workpieces must be properly positioned within the die cavities before and during the forging stroke. If the workpieces are not properly positioned, unsatisfactory parts may be produced. The known near net warm forging apparatuses and processes are unable to properly position workpieces if the workpieces do not snugly fit in the die cavity. Thus, the workpieces must be designed to snugly fit in the cavities.

However, there are many part configurations which can not be made from workpieces which snugly fit in the cavity—rather the workpieces are smaller than the cavity in at least one dimension, so that the workpieces can move within the cavity. If known near net warm forging apparatuses and parts are used when workpieces are free to move within the cavity, the resulting parts may not have the specified configuration and may be non-functional. Workpiece size and shape are important considerations in near net warm forging, because, as stated, the workpieces must have substantially the same volume as the finished parts.

The workpieces for near net warm forging also need to be symmetrical because they are dropped into the die cavities either manually or by a machine. The workpieces must fit in the cavities in only one orientation to ensure that they are properly oriented in the die cavities. For this reason, generally cylindrical workpieces are typically used. For certain part configurations, if the workpieces are long enough to engage opposing end walls of the cavities to prevent movement of the workpiece in that direction, the workpieces do not have enough volume to engage the side walls of the cavities. Consequently, the workpieces can move between the side walls. As stated, if the workpieces are not properly located between the side walls, the resulting forged parts may not be evenly filled or formed. Alternatively, the workpieces may be wide enough to engage the side walls of the cavities, preventing movement of the work pieces in that direction, but not have sufficient volume to engage the end walls of the cavities. Improper location exists under this condition.

Thus, if known near net warm forging apparatuses and processes are employed to manufacture parts from workpieces that do not snugly fit in the die cavities, the forged parts must be 100% manually sorted to separate the acceptable and defective parts to ensure that the defective parts are not provided to a customer. The sorting process introduces an added step and added costs into the part forming process. In addition, the defective parts that are eliminated by sorting must be scrapped or recycled. Thus, the known near net warm forming apparatuses and processes neither efficiently utilize material nor optimize the number of processing steps required to produce finished parts in these circumstances.

Thus, there is a need for apparatuses that are suitable for use in a forging press to near net warm forge metal parts having certain relatively complex configurations, and also for methods of near net warm forging such part configurations utilizing the apparatuses, that overcome the above-described problems.

SUMMARY OF THE INVENTION

Certain embodiments of the present invention provide punches and combinations of the punches and female dies that can be used to form axi-symmetrical workpieces into complex part shapes without incurring the above-described problems. The punches and female dies can be used in conventional forging presses to near net warm forge complex shaped parts. The present invention also provides methods utilizing the punches and female dies to produce such parts. The punches are moved downwardly in the female dies during the forging strokes to form the workpieces into the desired part configurations.

In certain embodiments, the female dies comprise a plurality of inner surfaces, including one or more curved inner surfaces defining sides of a cavity. The inner surfaces form side surfaces of the forged parts. The punches typically comprise one or more curved side surfaces, one or more planar end surfaces and a bottom (forming) surface. The side surfaces and end surfaces of the punch each mate with an inner surface of the dies when the punches are inserted in the cavities.

The workpieces are axi-symmetrical and typically have a length approximately equal to a length of the cavity.

Accordingly, the workpieces can be placed into the cavities such that opposed ends of the workpieces contact or are immediately adjacent to the opposed end surfaces of the cavities that define the length of the cavities. This contact prevents movement of the workpieces in the length direction of the cavities and allows ready orientation of the workpieces.

The workpieces may have a width of less than the width of the cavities. Accordingly, these workpieces can be moved in the width dimension of the cavities, and these workpieces are not automatically positioned in this dimension prior to forging. Alternatively, the workpieces may be prevented from moving in the width dimension, but free to move in the length direction.

In cases where the workpieces are restricted from moving in the length dimensions of the cavities, the bottom surfaces of the punches include chamfer surfaces which are shaped and positioned on the bottom surfaces such that the chamfer surfaces initially urge material of the workpieces to move in the width dimension of the cavities during forging to produce an evenly filled part, without the need to locate the workpieces in the width direction prior to forging. This movement causes the material to flow substantially evenly to all surfaces of the cavities, even to surfaces defining protrusions extending downwardly in the cavities. The relative effectiveness of the chamfer surfaces to urge material to move is related to the volume of the chamfers. The further away the workpiece is from the central axis, the greater is the required effect of the chamfer surfaces.

In cases where the workpieces are restricted from moving in the width dimension of the cavities, and are free to move in the length dimensions, the chamfer surfaces are positioned on the punches to move material of the workpieces in the length dimension.

The chamfer surfaces each extend outwardly at an acute angle relative to the longitudinal axes of the punches, and have a maximum depth at opposed edges of the bottom surface. The acute angle is typically from about 30° to about 60°, and is preferably about 40°–50°.

During warm forging, the punches and the female dies may, depending on the cavity in the dies, form the workpieces into forged parts which include one or more curved side surfaces, one or more planar end surfaces, a top pedestal surface, a step protruding from the pedestal surface, and a groove opposite to the step. The volume of the parts is substantially equal to the volume of the workpieces.

These punches and dies can consistently produce near net warm forged parts such as lugs that are evenly filled, without requiring that the workpieces be sized so that they cannot move in the width dimension of the cavity, or that the workpieces fit snugly in the width dimension. Thus, the present invention overcomes the above-described problems associated with known apparatus and processes for forming certain complex shaped parts by near net warm forging. Further, because the parts are near net warm forged, they have at most only a small volume of excess material. Due to this highly efficient utilization of material, only a relatively simple secondary finishing step is needed to produce the final parts. The present invention also eliminates the need to sort the forged parts and simplifies secondary finishing operations.

BRIEF DESCRIPTION OF THE DRAWINGS

The preferred embodiments of this invention will be described in detail, with reference to the following figures, in which:

FIG. 2A is a front, bottom and right side isometric view of a curved part which can be formed utilizing the apparatuses and methods of certain embodiments of the present invention;

FIG. 2B is a top, rear and left side isometric view of the part of FIG. 2A;

FIG. 3A is a left side, top and left end isometric view of a punch according to one embodiment of the present invention;

FIG. 3B is a front, bottom and right side isometric view of the punch of FIG. 3A, showing the forming surface at the bottom of the punch;

DETAILED DESCRIPTION OF PREFERRED EMBODIMENTS

Certain aspects of the present invention are directed to punches, and also to combinations of the punches and female dies, that can be used in conventional forging apparatuses to produce relatively complex part configurations by near net warm forging. These aspects of the present invention also provide methods which utilize these punches and female dies to produce such part configurations by near net warm forging.

The parts are forged using workpieces having a volume (and weight) substantially equal to the volume (and weight) of the finished parts. Accordingly, the present invention produces forged parts with at most only a minimal amount of excess material (flash), and the as-forged parts can be finished using only a relatively simple secondary finishing step.

Figure 1:
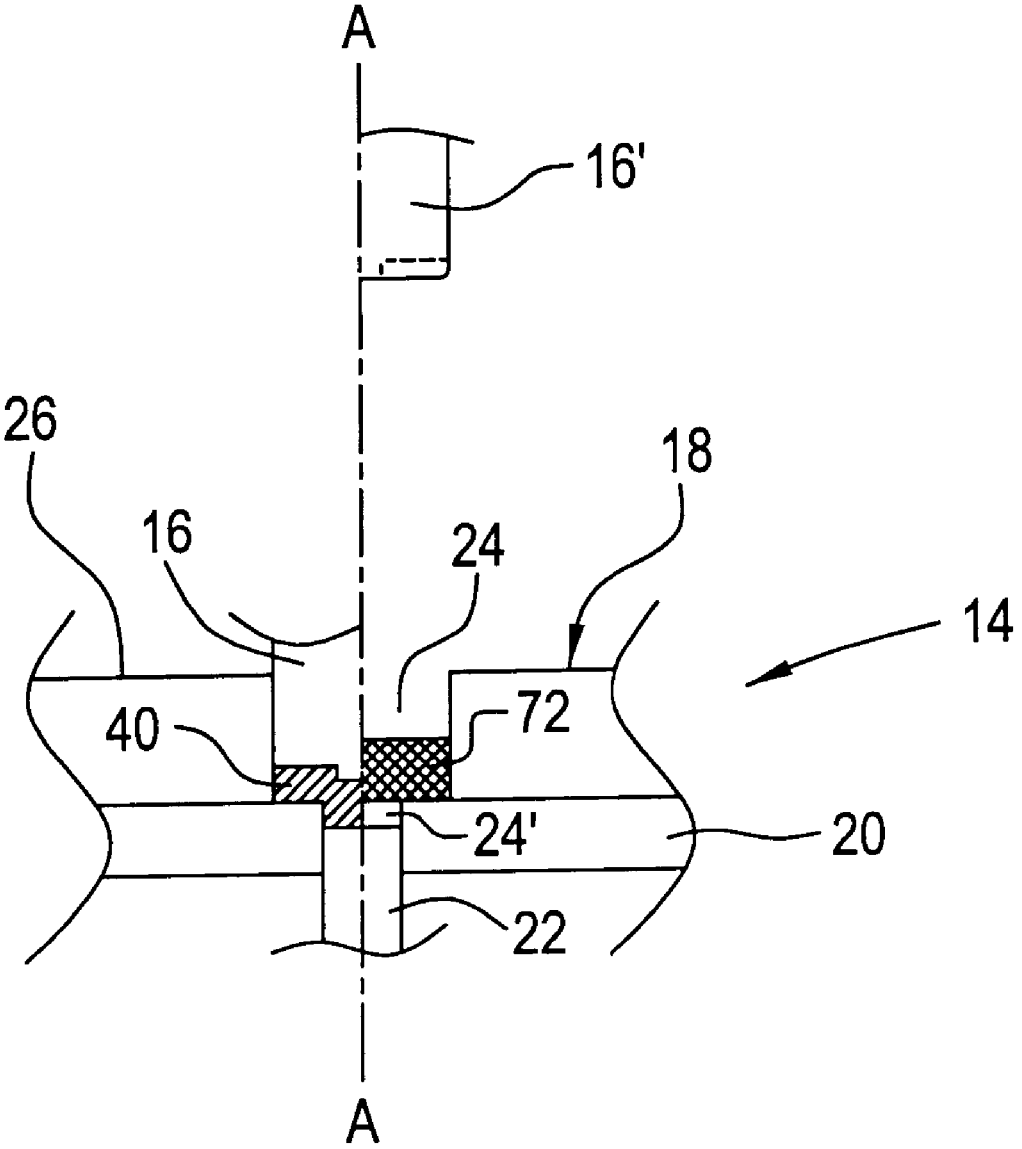
FIG. 1 is a partially broken away, split (along axis A—A) elevational view of a punch and a closed die set, according to an embodiment of the present invention, illustrating the punch in the down position on the left side and in the up position on the right side.

FIG. 1 illustrates a punch 16 and a closed die set 14 according to an embodiment of the present invention. During forging, the punch 16 and the die set 14 are typically vertically oriented as shown. Warm forging processes utilizing a punch 16 and closed die set 14 as illustrated in FIG. 1 are typically conducted at a temperature range of from about 1200° F. to about 2200° F. The appropriate warm forging temperature to produce a particular part is dependent on many factors, including the part configuration and composition, and the configuration and composition of the die set.

The illustrated closed die set 14 includes an upper female die 18, a die member 20 directly below the female die 18, and an ejector 22. The remainder of the closed die set 14 is not a part of the present invention. Closed die sets such as closed die set 14 are well known in the art and the complete closed die set 14 is not illustrated or described in detail herein.

The female die 18, die member 20 and ejector 22 together define the die cavity 24 in the die set 14 in which workpieces (billets) are formed into parts by warm forging. The cavity 24 is open at the top surface 26 of the female die 18. The female die 18 defines the major volume (or upper portion) of the cavity 24, and the die member 20 and the ejector 22 define the remainder (or lower portion) 24' of the cavity 24.

Referring to FIGS. 4A, 4B, 5A and 5B, the female die 18 includes two opposed curved inner side surfaces 62, 64 defining a width of the cavity 24, and two planar inner end surfaces 66, 68 defining the length of the cavity 24. The inner surfaces define, in part, the shape of the forged parts. In other embodiments of this invention, the female die 18 can include only one curved inner surface, more than two curved inner surfaces, or other configurations, depending on the desired shape of the finished part.

Figure 5A:
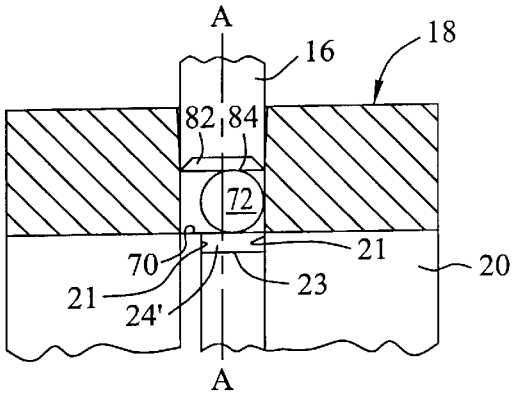
FIG. 5A is a partial sectional view along line 5A—5A of FIG. 4A illustrating initial contact between the bottom (forming) surface of the punch which moves along axis A—A during the forging cycle.
Figure 5B:
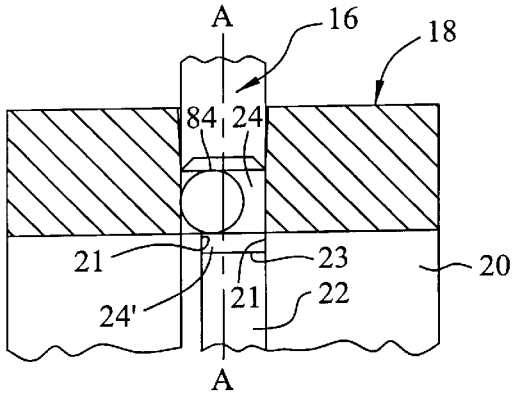
FIG. 5B is a partial sectional view along line 5B—5B of FIG. 4B illustrating initial contact between the bottom surface of the punch and the workpiece.

A portion of the die member 20 including the top surface 70 is also shown in FIGS. 5A and 5B. The top surface 70 of the die member 20 supports the workpiece 72 during forging. The die member 20 also includes opposed planar side surfaces 21 and a bottom surface which, with a planar top surface 23 of the ejector 22, define the lower portion 24' of the die cavity 24, when the ejector 22 is in the illustrated forging position.

The ejector 22 functions to eject forged parts from the cavity 24. This is accomplished by moving the ejector 22 upwardly along the axis A—A when the punch 16 has completed a forging cycle and is in the up position.

FIGS. 3A and 3B illustrate a punch 16 which can be used in combination with the die set 14 in a forging apparatus. The punch 16 is positioned so that it moves vertically in the die cavity 24 during the forging stroke. The left side of FIG. 1 (to the left of axis A—A) illustrates the punch 16 in the lowermost position, and the right side of FIG. 1 illustrates the punch 16' in the uppermost position. In the right side of FIG. 1, the workpiece (or billet) 72 has been inserted into the die cavity 24 to be forged. The forged part 40 is illustrated in the left side of FIG. 1.

The punch 16 is sized and configured to move along the height of the female die 18 during the forging stroke. As shown, the punch 16 comprises two opposed curved side surfaces 74, 76 and two opposed planar end surfaces 78, 80. The punch 16 also includes a longitudinal central axis C—C and a transverse axis D—D. The curved side surface 74 of the punch 16 mates with the curved inner side surface 64 of the female die 18; the curved side surface 76 mates with the curved inner side surface 62; the planar end surface 78 mates with the planar inner end surface 68; and the planar end surface 80 mates with the planar inner end surface 66, during the forging stroke. The punches for other die cavity shapes will have exterior surfaces which match the interior surfaces defining the cavities.

The punch 16 further comprises a bottom (forming) surface 82 including a nose 84, two planar surfaces 94, and two pairs of opposed chamfer surfaces 86, 88 and 90, 92, respectively disposed on opposite sides of the nose 84. The nose 84 is centrally located along the transverse axis D—D. The pairs of chamfer surfaces 86, 88 and 90, 92 are respectively laterally spaced from the longitudinal central axis C—C of the punch 16. A planar surface 94 is disposed between each of the pairs of chamfer surfaces. The planar surfaces 94 are typically parallel to the nose 84. In cases where the length is the dimension in which the workpiece was not properly located, the chamfer surfaces 86, 88, 90 and 92 would be required to be located at opposing ends of axis D—D of the punch 16.

Figure 7:
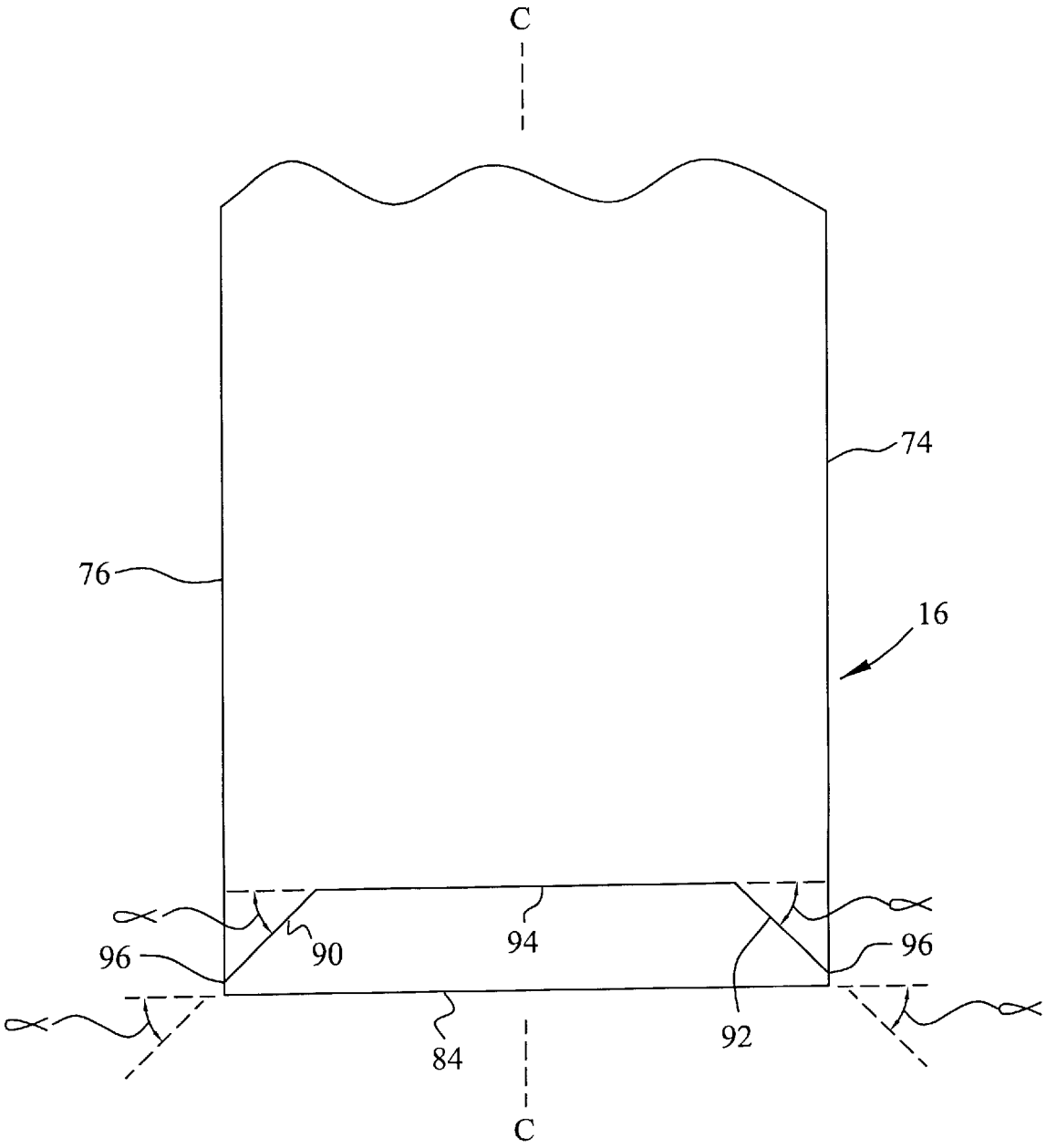
FIG. 7 is a side elevational view of a punch of FIGS. 3A and 3B, illustrating the angle $\alpha$ between the chamfer surfaces and the nose at the bottom surface.

Referring to FIG. 7, the chamfer surfaces 86, 88, 90, 92 (only chamfer surfaces 90, 92 are shown) each extend downwardly at an acute angle $\alpha$ relative to the planar surfaces 94. The chamfer surfaces 86, 90 extend downwardly as an extension, in effect, of the outer surface 76 of the punch 16, and the chamfer surfaces 88, 92 extend downwardly as an extension, in effect, of the outer surface 74. The chamfer surfaces each have their maximum "depth" at opposed edges 96 of the bottom surface 82 (see FIG. 7).

The acute angle $\alpha$ between each of the chamfer surfaces 86, 88, 90, 92 and the surfaces 94 are approximately equal. This angle typically is in the range of from about 30° to about 60°. The acute angle is preferably from 40° to about 50°. Chamfered surfaces at an angle less than about 30° may not satisfactorily move material of the workpiece in the die cavity 24 to properly form parts as described in greater detail below. Chamfered surfaces having an angle greater than about 60° may be weak and make the punch 16 susceptible to breakage. Chamfered surfaces at an acute angle of about 30°–60° can both properly move material of the workpiece 72 and provide adequate strength to the punch 16.

The punch 16 can be formed of a suitable material such as a tool steel. The bottom surface 82 of the punch 16 is preferably formed by an electrical discharging machinery (EDM) process. This process can form the contour of the bottom surface 82 of the punch 16 even in hard materials such as hardened tool steels.

Figure 6:
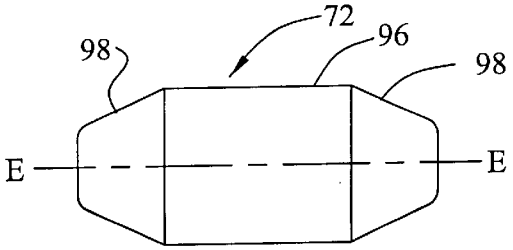
FIG. 6 illustrates a workpiece (billet) configuration that is suitable for use with the punch and die of FIGS. 3A, 3B, 4A and 4B.

FIG. 6 illustrates a workpiece 72 which is suitable for use in the present invention. The workpiece 72 is symmetrical along a longitudinal central axis E—E (i.e., axi-symmetrical). The workpiece 72 is generally cylindrical shaped and includes a cylindrical central portion 96 and conical end portions 98. The volumes of the central portion 96 and the end portions 98 can be varied to vary the volume of the workpiece 72, depending on the desired volume and configuration of the part. It will be understood by those skilled in the art that the workpiece 72 can be of other axi-symmetrical shapes including, for example, other generally cylindrical shapes or oval shapes. The shape of the workpiece 72 is dependent on the configuration of the die cavity, which depends on the desired configuration of the part.

Figure 4A:
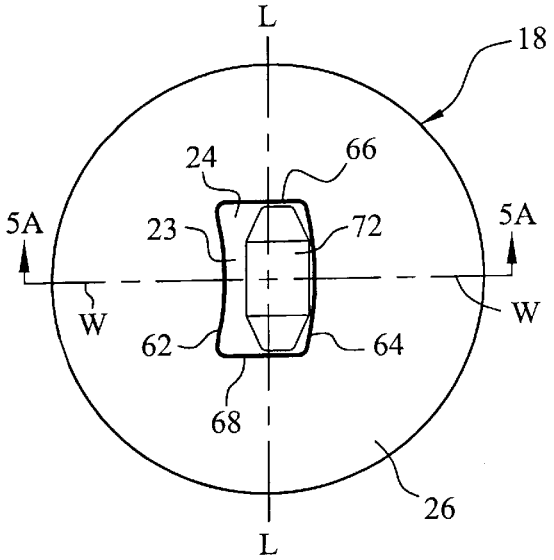
FIGS. 4A and 4B are plan views of the female die which can be employed with the punch of FIGS. 3A and 3B, showing the shape of the die cavity and alternate locations of a workpiece in the width dimensions of the cavity prior to contact between the workpiece and the punch.
Figure 4B:
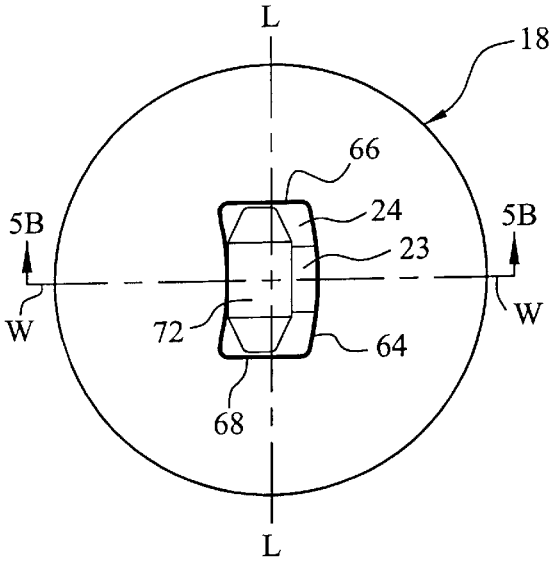

The workpiece 72 typically has a length along the longitudinal central axis E—E substantially equal to a length of the cavity 24 along axis L—L (see FIGS. 4A and 4B). Accordingly, the workpiece 72 fits closely along the length of the cavity 24. This causes the workpiece 72 to properly position in the cavity 24 when the workpiece 72 is inserted into the cavity 24.

FIGS. 2A and 2B illustrate an exemplary complex part configuration that can be formed by near net warm forging utilizing the apparatuses and methods of certain embodiments of the present invention. The illustrated part is a wide-bodied lug 40. The lug 40 includes a longitudinal central axis B—B which defines the length of the lug. The lug 40 includes opposed curved side surfaces 42, 44; opposed planar end surfaces 46, 48; a top pedestal surface 50; bottom surfaces 52; angled side surfaces 54 (which are angled inwardly toward the bottom surfaces 52); angled side surfaces 56 (only one side surface 56 is shown also angled inwardly toward the bottom surfaces 52); a bottom groove 57 formed by surface 58 and opposed side surfaces 59; and a step 60 which is located approximately centrally along the longitudinal central axis B—B and protrudes from the pedestal surface 50. The pedestal surface 50 and bottom surfaces 52 are typically flat and oriented approximately perpendicular to the planar end surfaces 46, 48.

It is important that the die cavity forming parts such as lug 40 be evenly filled. Otherwise, portions of the parts may be oversized while other portions may be undersized. Such unevenly filled parts may be defective. Further, rollover and other detrimental forging phenomenon may occur if the cavity is unevenly filled. Rollover may occur if material flows along a surface and engages material moving in a different direction during forging. This may result in defective parts.

The process of using the forging press 12 and closed die set 14 will now be described for the condition where the workpiece 72 is located in the length dimension. The forging process begins with punch 16 in the up position. A workpiece 72 is inserted into cavity 24. Punch 16 is then lowered into the die set 14. Bottom surface 82 first contacts workpiece 72.

Specifically, during the forging stroke, the nose 84 of the punch 16 initially contacts the workpiece 72 at only a small surface area of the workpiece 72. See FIGS. 5A and 5B. Subsequently during the forging stroke, the chamfer surfaces 86, 90 or 88, 92 of the punch 16 contact the workpiece 72. The chamfer surfaces that first contact the workpiece 72 depends on the position of the workpiece 72 within the cavity 24. If the workpiece 72 is located as shown in FIG. 4A, the chamfer surfaces 88, 92 contact the workpiece 72 next; but if the workpiece 72 is located as shown in FIG. 4B, the chamfer surfaces 86, 90 contact the workpiece 72 next.

The chamfer surfaces 86, 90 or 88, 92 urge the flow of material of the workpiece 72, at least in part, in a direction perpendicular to the longitudinal central axis C—C of the punch 16, along axis W—W of the cavity 24. Chamfer surfaces 88, 92 cause workpiece material to move in the direction toward curved inner side surface 62 (FIG. 5A), and chamfer surfaces 86, 90 cause workpiece material to move toward curved inner side surface 64 (FIG. 5B). This material movement also promotes the movement of material into portion 24' of the cavity 24, i.e., this directing of material inwardly causes the material to fill portion 24'. This material movement occurs until sufficient surface area of the workpiece 72 contacts the punch 16 such that the corresponding surface friction force (between workpiece 72 and bottom surface 82) exceeds the force applied on the workpiece 72 by the punch 16. At this point, the effect of the chamfer surfaces in moving material is negated and the material then completely fills the cavity 24.

Accordingly, the chamfer surfaces 86, 88, 90 and 92 can move material of the workpiece 72 in the cavity 24 to consistently produce evenly filled parts, regardless of the initial position of the workpiece 72 along axis W—W of the cavity 24. The chamfer surfaces 86, 88, 90 and 92 move the material inwardly so that the portion 24' of the cavity 24 is filled at substantially the same time as the other portions of cavity 24, i.e., the material of the workpiece 72 contacts all inner surfaces forming cavity 24 at substantially the same time.

Thus, the chamfer surfaces 86, 88, 90 and 92 eliminate the need to use a workpiece 72 having enough material to fill the cavity 24 along axis W—W, so as to prevent movement of the workpiece 72 in this direction of the cavity 24. The workpiece 72 can be sized so that it is able to move in the width dimension W—W of the cavity 24 and still have sufficient volume to produce the lug 40. It is only necessary that the workpiece 72 have a length that approximately equals the length dimension L—L of the cavity 24 to ensure that the workpiece 72 will be properly formed. Thus, the female die 18 and punch 16 simplify the selection of workpiece that can be used in the female die 18 to produce relatively complex shaped parts such as the lug 40.

During the above-described forging of the workpiece to form the lug 40, the bottom surface 82 of the punch forms angled side surfaces 54, angled side surfaces 56, bottom groove 57 and bottom surfaces 52. The nose 84 of the punch 16 forms the groove 57 in the lug 40. The step 60 on the pedestal surface 50 of the lug 40 is formed in the lower portion 25 of the cavity 24 (see FIG. 1).

The resulting forged part is substantially evenly filled throughout its volume and also properly configured. Furthermore, the forged part has substantially the same volume as the finished part. Any excess material that may be formed on the part during the warm forging process using the punch and female die according to the present invention can be easily finished by a relatively simple secondary finishing step. For example, a plurality of as-forged parts can be tumbled together in a tumbler so as to form the finished surface on the part.

While the invention has been described in conjunction with the specific embodiments described above, it is evident that many alternatives, modifications and variations are apparent to those skilled in the art. Accordingly, the preferred embodiments of the invention as set forth above are intended to illustrative and not limiting.

What is claimed is:

1. A punch for use with a female die set to near net warm forge a workpiece to produce a part, the female die set defining a cavity having dimensions defined by opposing end and side surfaces, the punch comprising:

opposing side and end surfaces, each of the surfaces mating with a corresponding surface of the female die set during the forging stroke of the punch; and a bottom surface including at least one pair of opposed chamfer surfaces, the chamfer surfaces extending along and having a maximum depth at either the opposed side or the opposed end surfaces of the bottom surface, the chamfer surfaces being shaped and positioned on the bottom surface to engage the workpiece and urge the flow of the workpiece material along a dimension of the cavity substantially transverse to the chamfer surfaces during forging, when the workpiece is positioned in the cavity.

2. The punch of claim 1, wherein the bottom surface of the punch further comprises a nose forming a leading surface of the punch, and each of the chamfer surfaces extends downwardly at an acute angle relative to a longitudinal axis of the punch.

3. The punch of claim 2, wherein the acute angle is in a range of from about 30° to about 60°.

4. The punch of claim 3, wherein the acute angle is from about 40° to about 50°.

5. The punch of claim 2, wherein the punch is movable within the cavity of the female die during the forging stroke such that the nose initially contacts the workpiece and forms the groove in the part, and the chamfer surfaces next contact the workpiece and urge workpiece material to flow along the dimension of the cavity substantially transverse to the chamfer surfaces.

6. The punch of claim 1, wherein the workpiece is axi-symmetrical and has a width less than the width of the cavity.

7. The punch of claim 1, wherein the workpiece has a length substantially equal to the length of the cavity, and when the workpiece is positioned in the cavity opposed ends of the workpiece are positioned relative to the opposed end surfaces of the cavity to substantially prevent movement of the workpiece along the length of the cavity.

8. The punch of claim 7, wherein the punch is movable within the cavity of the female die set during the forging stroke such that the bottom surface of the punch contacts the workpiece and causes material of the workpiece to move along the dimension of the cavity substantially transverse to the chamfer surfaces so as to produce a substantially evenly filled part.

9. The punch of claim 1, wherein the chamfer surfaces extend along and have a maximum depth at the opposed side surfaces, and the chamfer surfaces urge the flow of workpiece material along the width of the cavity during forging.

10. The punch of claim 1, wherein the female die set includes an upper female die, a lower die member and an ejector which define the cavity, and wherein the upper female die defines an upper cavity portion of the cavity and the lower die member and the ejector define a lower cavity portion of the cavity, the lower cavity portion being shorter in length than the upper cavity portion.

11. The punch of claim 10, wherein the workpiece is positioned in the upper cavity portion prior to warm forging, and the chamfer surfaces urge the flow of the workpiece material along the dimension of the cavity substantially transverse to the chamfer surfaces during warm forging.

12. The punch of claim 11, wherein the bottom surface of the punch contacts the workpiece and forms an evenly filled step on a surface of the part in the lower cavity portion during warm forging.

13. The punch of claim 1, wherein the punch comprises a pair of opposed curved side surfaces, the opposed side surfaces of the cavity comprise opposed curved inner surfaces, and each of the curved side surfaces of the punch mates with a curved inner surface of the female die during the forging stroke of the punch.

14. An apparatus for near net warm forging a workpiece to produce a part including at least one curved side surface, a top surface, a bottom surface and a stepped portion extending upward from the top surface, the apparatus comprising:

a female die set including at least one curved inner surface forming a side of a cavity, the cavity having a width and a length; and a punch movable within the cavity during a forging stroke of the punch, the punch comprising:

at least one curved side surface, each of the curved side surfaces mating with one of the curved inner surfaces of the female die during the forging stroke of the punch; and a bottom surface including at least one pair of opposed chamfer surfaces, the chamfer surfaces having a maximum depth at opposite edges of the bottom surface, the chamfer surfaces being shaped and positioned on the bottom surface to engage the workpiece and urge the flow of the workpiece material along the dimension of the cavity transverse to the chamfer surfaces during forging, when the workpiece is positioned in the cavity.

15. The apparatus of claim 14, wherein the bottom surface of the punch further comprises a nose and a pair of chamfer surfaces disposed, respectively, at two opposite sides of the nose, each of the chamfer surfaces extending downwardly at an acute angle relative to a longitudinal axis of the punch.

16. The apparatus of claim 15, wherein the punch is movable within the cavity during the forging stroke such that the nose initially contacts the workpiece, and the chamfer surfaces next contact the workpiece and urge material of the workpiece to move along the width of the cavity so that the forged part is substantially evenly filled.

17. The apparatus of claim 14, wherein the acute angle is in a range of from about 30° to about 60°.

18. The apparatus of claim 17, wherein the acute angle is about 40° to about 50°.

19. The apparatus of claim 14, the workpiece having a longitudinal axis along which the workpiece is symmetrical.

20. The apparatus of claim 14, wherein the workpiece has a length substantially equal to the length of the cavity and a width less than the width of the cavity, so that the workpiece is movable substantially only along the width of the cavity when positioned in the cavity, and the bottom surface of the punch moves material of the workpiece along the width of the cavity during warm forging to produce a substantially evenly filled part.

21. The apparatus of claim 14, wherein the female die set includes an upper female die, a lower die member and an ejector which define the cavity, and wherein the upper female die defines an upper cavity portion of the cavity and the lower die member and the ejector define a lower cavity portion of the cavity, the lower cavity portion being shorter in length than the upper cavity portion.

22. The apparatus of claim 21, wherein the workpiece is positioned in the upper cavity portion prior to warm forging, and the chamfer surfaces urge the flow of the workpiece material along the width of the cavity during forging.

23. The apparatus of claim 22, wherein the bottom surface of the punch contacts the workpiece and forms an evenly filled step on a surface of the part in the lower cavity portion during warm forging.

24. A method of near net warm forging a workpiece to produce a part, comprising the steps of:

providing a female die set comprising at least one curved inner surface forming a side of a cavity, the cavity having a length and a width;

providing a punch comprising:

at least one curved side surface, each of the curved side surfaces mating with one of the curved inner surfaces of the female die set during the forging stroke of the punch; and a bottom surface including at least one pair of opposed chamfer surfaces, the chamfer surfaces having a maximum depth at opposite edges of the bottom surface;

providing a workpiece having a longitudinal axis along which the workpiece is symmetrical, and a dimension substantially equal to either the length or the width of the cavity;

placing the workpiece into the cavity such that the workpiece is adjacent to opposed inner surfaces of the cavity such that the opposed inner surfaces substantially prevent movement of the workpiece along either the length or the width of the cavity, the workpiece being at a warm forging temperature; and moving the punch in the cavity so that the chamfer surfaces engage the workpiece and urge the flow of the workpiece material along a dimension of the cavity substantially transverse to the chamfer surfaces so as to warm form a substantially evenly filled part, the part including at least one curved side surface, a top pedestal surface and a step protruding from the pedestal surface.

25. The method of claim 24, wherein the punch has a longitudinal axis, the bottom surface of the punch comprises a nose and a pair of chamfer surfaces disposed, respectively, at each of two opposite sides of the nose, each of the chamfer surfaces extending downwardly at an acute angle relative to the longitudinal axis of the punch.

26. The method of claim 24, wherein the acute angle is in a range of from about 30° to about 60°.

27. The method of claim 24, wherein the female die set includes an upper female die, a lower die member and an ejector which define the cavity, and wherein the upper female die defines an upper cavity portion of the cavity and the lower die member and the ejector define a lower cavity portion of the cavity, the lower cavity portion being shorter in length than the upper cavity portion.

28. The method of claim 27, wherein the workpiece is positioned in the upper cavity portion prior to warm forging, and the chamfer surfaces urge the flow of the workpiece material along the width of the cavity during forging.

29. The method of claim 28, wherein the bottom surface of the punch contacts the workpiece and forms an evenly filled step on a surface of the part in the lower cavity portion during warm forging.

30. The method of claim 24, wherein the chamfer surfaces move the material along the width of the cavity.

31. A near net warm forged part forged according to the method of claim 24.

32. A method of near net warm forging an axi-symmetrical workpiece to produce a lug, comprising the steps of:

providing a female die set comprising a pair of opposed curved inner surfaces forming opposed sides of a cavity, the cavity having a length and a width;

providing a punch comprising:

a longitudinal axis;

a pair of opposed curved side surfaces, each of the curved side surfaces mating with one of the curved inner surfaces of the female die set during the forging stroke of the punch; and a bottom surface including at least one pair of chamfer surfaces, each of chamfer surfaces extending at an acute angle in a range of from about 30° to about 60° relative to the longitudinal axis, one of the chamfer surfaces of each pair of chamfer surfaces extending downwardly from one of the curved side surfaces of the punch, the other chamfer surface of each pair of chamfer surfaces extending downwardly from the other curved side surface of the punch, and the chamfer surfaces being spaced along the width of the cavity from the axis of the cavity during the forging stroke;

placing a workpiece into the cavity of the female die set such that the workpiece can be moved substantially only along the width of the cavity; and moving the punch in the forging stroke in the cavity such that the chamfer surfaces contact the workpiece and urge material of the workpiece to move along the width of the cavity to form the workpiece into an evenly filled lug, the lug including a pair of opposed curved side surfaces, a top pedestal surface, a step protruding from the pedestal surface, and a bottom groove opposite to the step.

33. The method of claim 32, wherein the acute angle is from about 40° to about 50°.

34. The method of claim 32, wherein the bottom surface of the punch further comprises a nose disposed between the chamfer surfaces which initially contacts the workpiece and forms the groove in the lug.

35. The method of claim 32, wherein the workpiece is generally cylindrically shaped.

36. The method of claim 32, wherein the female die set includes an upper female die, a lower die member and an ejector which define the cavity, and wherein the upper female die defines an upper cavity portion of the cavity and the lower die member and the ejector define a lower cavity portion of the cavity, the lower cavity portion being shorter in length than the upper cavity portion.

37. The method of claim 36, wherein the workpiece is positioned in the upper cavity portion prior to warm forging, and the chamfer surfaces urge the flow of the workpiece material along the width of the cavity during forging.

38. The method of claim 37, wherein the bottom surface of the punch contacts the workpiece and forms an evenly filled step on a surface of the part in the lower cavity portion during warm forging.

39. A lug forged according to the method of claim 32.

* * * * *